US005485996A

United States Patent [19]

Niksich

[11] Patent Number: 5,485,996

[45] Date of Patent: Jan. 23, 1996

[54] END COVER FOR THE HANDLE OF A SPORTS DEVICE

[76] Inventor: Gene Niksich, 840 McFarland Rd., Alpharetta, Ga. 30201

[21] Appl. No.: 323,011

[22] Filed: Oct. 14, 1994

[51] Int. Cl.[6] ..... A63B 49/00; A63B 49/08

[52] U.S. Cl. ..... 273/75; 273/81 D

[58] Field of Search ..... 273/73 R, 73 J, 273/75, 81 R, 81 B, 81 D, 67 R

[56] References Cited

U.S. PATENT DOCUMENTS 4,591,156 5/1986 Attenni ..... 273/73 J
4,936,586 6/1990 Van Raemdonck ..... 273/73 J
5,058,902 10/1991 McCutchen ..... 273/73 J
5,125,655 6/1992 Crooks ..... 273/81 B X
5,295,684 3/1994 Bracho ..... 273/73 J

*Primary Examiner*—Raleigh W. Chiu
*Attorney, Agent, or Firm*—Norman B. Rainer

[57] ABSTRACT

A cover for the butt end of the handle of a tennis racket is fabricated of a silicone polymer as a monolithic cup-like structure having a downwardly convex bottom portion of circular perimeter and a sidewall portion of upwardly convergent conic contour emergent from said perimeter. The sidewall portion tapers to form a very thin lip which securely grips the handle of the racket without presenting to the user's hand a perceptible feeling of structure.

1 Claim, 1 Drawing Sheet

END COVER FOR THE HANDLE OF A SPORTS DEVICE

BACKGROUND OF THE INVENTION

1. Field of the Invention

This invention concerns a cap adapted to be emplaced upon the butt extremity of the handle of a device adapted to undergo repeated swinging motion.

2. Background of the Invention

Sporting equipment such as tennis rackets and baseball bats are gripped by the user at the extremity of the handle portion, referred to as the butt extremity, where there is usually an annular protrusion which prevents the hand from slipping off the handle. The intense and repeated force of contact of the user's hand with said protrusion can cause pain and soreness. The problem is intensified when the protrusion becomes damaged or toughened in the course of long use, and in handles of polygonal contour where apex corner edges are disposed at the butt.

Various types of caps have been disclosed for emplacement upon the butt of the handle of sports devices. For example, U.S. Pat. No. 5,000,452 discloses a cap for the handle of a racket for ball games, the cap being intended to fit over a wrapping applied to the handle. U.S. Pat. No. 4,984,793 discloses an elongated multicomponent cap for a racket handle, said cap being fabricated of a pliant thermoplastic rubber having a Shore A hardness in the range of 55 to 60. U.S. Pat. No. 5,069,452 discloses a racket handle butt plate comprising an elongated octangular socket body made of rigid plastic, and covered with a layer of resilient material. U.S. Pat. No. 3,608,325 concerns an end cap for a golf club, said cap being fabricated of metal and adapted to secure a spirally wrapped leather gripping material on the handle.

The aforesaid Patents do not address the problem of alleviating the discomfort inflicted upon the palm of the user's hand, or the prevention of wear of the butt of the handle.

It is accordingly an object of the present invention to provide an improved end cap for the butt extremity of a handle of a device intended to be manually swung.

It is a further object of this invention to provide a cap as in the foregoing object which provides comfort to the palm of the user's hand.

It is another object of the present invention to provide a cap of the aforesaid nature which can be securely emplaced upon butt extremities of varied diameter.

It is still another object of this invention to provide a cap of the aforesaid nature which secures a wrapping material upon said handle.

It is yet another object of the present invention to provide a cap of the aforesaid nature which is easily emplaced and of simple, durable construction amenable to low cost manufacture.

These and other beneficial objects and advantages will be apparent from the following description.

SUMMARY OF THE INVENTION

The above and other beneficial objects and advantages are accomplished in accordance with the present invention by a cover for the butt extremity of a handle comprising a cup-shaped monolithic structure fabricated of a silicone polymer having a Shore A hardness between 40 and 50 and an elongation to break between 100% and 250%, said cover having a downwardly convex bottom portion of circular perimeter and a sidewall portion upwardly directed from said perimeter and terminating in a circular upper extremity representing the opening of said cup, said sidewall portion contoured as an upwardly convergent conical section bounded by interior and exterior surfaces which are upwardly convergent in a manner causing the thickness of said sidewall portion to diminish progressively with distance from said bottom portion, producing at said upper extremity an extremely thin lip adapted to snugly embrace said handle without presenting a perceptible feeling of structure.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
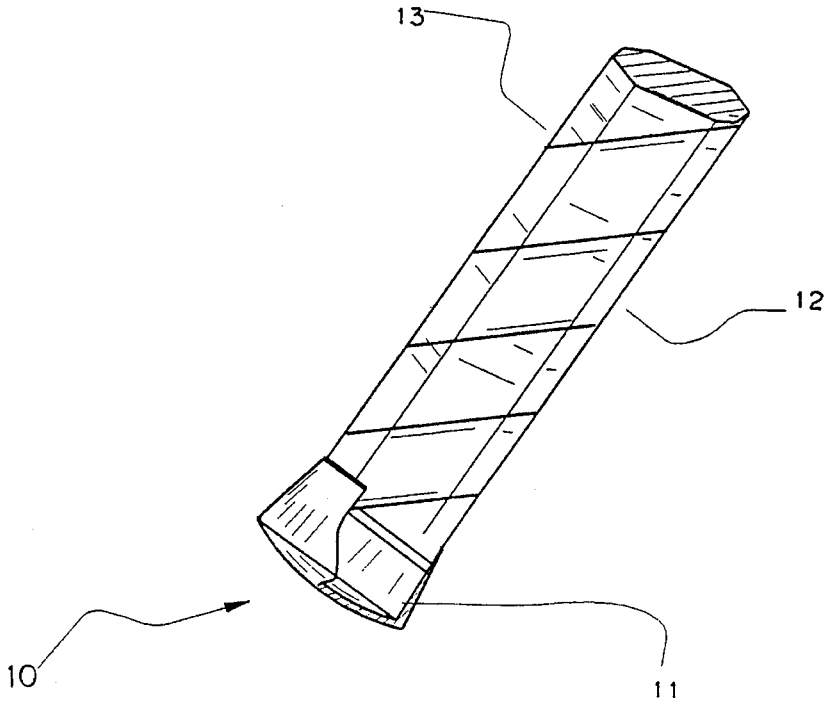
FIG. 1 is a perspective view of an embodiment of the end cover of the present invention, with portions broken away, shown in functional association with the butt extremity of a handle.
Figure 2:
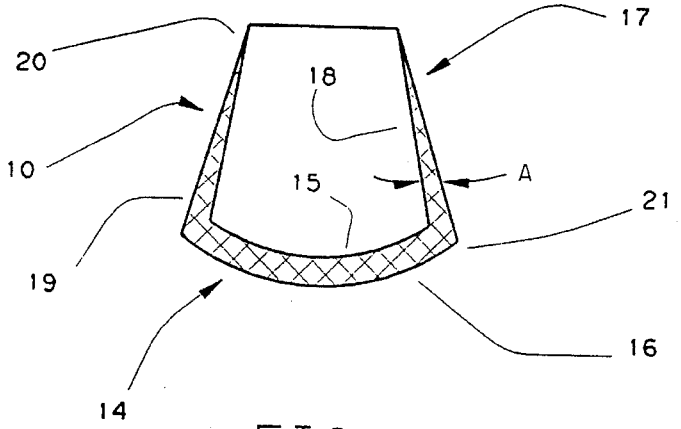
FIG. 2 is a vertical sectional view of the end cover of FIG. 1.
Figure 3:
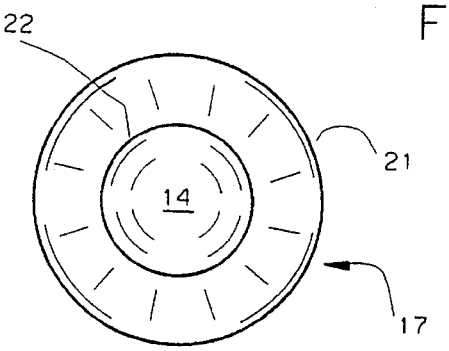
FIG. 3 is a top view thereof.
Figure 4:
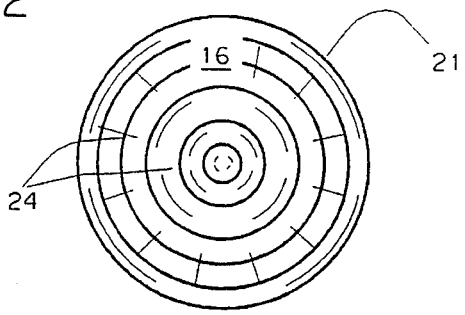
FIG. 4 is a bottom view.

Referring to FIGS. 1–4, an embodiment of the end cover 10 of the present invention is shown emplaced upon the butt extremity 11 of handle 12. A grip-enhancing wrapping 13 is also disposed upon the handle, and extends to said butt extremity where it is lies beneath said end cover.

End cover 10 is a cup-shaped monolithic structure fabricated of a silicone polymer by way of a molding operation. The silicone polymer has a Shore A hardness between 40 and 50, and an elongation to break between 100% and 250%. The Shore A hardness test is pursuant to ASTM method D2240, and the elongation to break test is pursuant to ASTM method D412. The abbreviation ASTM stands for: American Society for Testing and Materials. The silicone polymer may be a translucent or pigmented composition.

The end cover has a downwardly convex bottom portion 14 defined by upper and lower surfaces 15 and 16, respectively and circular perimeter edge 21. The thickness of the bottom portion, measured between said upper and lower surfaces, is preferably in the range of 2 to 3 millimeters. A sidewall portion 17 is upwardly directed from the perimeter of said bottom portion, and is defined by interior surface 18 and opposed exterior surface 19. Sidewall portion 17 is configured as an upwardly convergent conic surface. Said interior and exterior surfaces converge in the upward direction at an angle A having a value between about 0.5 and 2.0 degrees. There is thereby formed at upper extremity 22 an extremely thin lip 20 adapted to snugly embrace said handle without presenting a perceptible feeling of structure. The thickness of sidewall portion 17 of said lip should be in the range of 0.05 to 0.3 millimeters to achieve the aforesaid advantages.

The diameter of the end cover, measured diametrically across said lip portion, may range from about 1 inch to 2 inches. The height of the end cover, measured between upper extremity 22 and lower surface 16 of said bottom portion, may range between about 1 and 2 inches. The ratio of said diameter to said height is preferably in the range of 0.5 to 0.8.

The elasticity of the silicone material enables the end cover to be snugly emplaced over the butt of the handle, and further enables it to secure the wrapping. The softness of the silicone and its physiologically inert properties engenders comfort to the palm of the user's hand. Lower surface 16 may be provided with a series of upraised annular ridges 24. It has been found that said series of annular ridges, acting in concert with the downwardly convex nature of bottom portion 14, produces a non-slip grip in the palm of the user's hand without producing irritation.

When transparent, the silicone enables the user to see the label usually present on the end of the handle. The label is often used in determining order of service in tennis. Similar comfort advantages are also important to hand tools such as hammers.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A cover for the butt extremity of a handle comprising a cup-shaped monolithic structure fabricated of a silicone polymer having a Shore A hardness between 40 and 50 and an elongation to break between 100% and 250%, said cover having a downwardly convex bottom portion of circular perimeter and a sidewall portion upwardly directed from said perimeter and terminating in a circular upper extremity representing the opening of said cover, said sidewall portion contoured as an upwardly convergent conical section bounded by interior and exterior surfaces which are upwardly convergent in a manner causing the thickness of said sidewall portion to diminish progressively with distance from said bottom portion, producing at said upper extremity an extremely thin lip adapted to snugly embrace said handle without presenting a perceptible feeling of structure, said bottom portion being defined by an upper surface and a lower surface having a series of upraised annular ridges.

* * * * *